US009800023B2

(12) United States Patent
Niessner et al.

(10) Patent No.: US 9,800,023 B2
(45) Date of Patent: Oct. 24, 2017

(54) SPARK PLUG

(71) Applicant: Federal-Mogul Ignition GmbH, Neuhaus-Schierschnitz (DE)

(72) Inventors: Werner Niessner, Steinheim (DE); Matthias Blankmeister, Heiligenhaus (DE)

(73) Assignee: FEDERAL-MOGUL IGNITION GMBH, Neuhaus-Schierschni (DE)

( * ) Notice: Subject to any disclaimer, the term of this patent is extended or adjusted under 35 U.S.C. 154(b) by 0 days.

(21) Appl. No.: 15/380,323

(22) Filed: Dec. 15, 2016

(65) Prior Publication Data

US 2017/0170636 A1 Jun. 15, 2017

(30) Foreign Application Priority Data

Dec. 15, 2015 (DE) ..... 10 2015 121 862

(51) Int. Cl.
*H01T 13/46* (2006.01)
*H01T 13/39* (2006.01)
*H01T 13/32* (2006.01)

(52) U.S. Cl.
CPC ..... *H01T 13/467* (2013.01); *H01T 13/32* (2013.01); *H01T 13/39* (2013.01)

(58) Field of Classification Search
None
See application file for complete search history.

(56) References Cited

U.S. PATENT DOCUMENTS

| | | | | |
|---|---|---|---|---|
| 3,061,756 | A | 10/1962 | Henderson | |
| 3,753,795 | A | 8/1973 | Weber | |
| 4,427,915 | A | 1/1984 | Nishio | |
| 4,581,558 | A | 4/1986 | Takamura | |
| 4,743,793 | A * | 5/1988 | Toya | B22F 1/025 313/141 |
| 5,510,667 | A | 4/1996 | Loffler | |
| 5,551,902 | A | 9/1996 | Hubert | |
| 6,335,587 | B1 * | 1/2002 | Matsubara | H01T 13/20 313/123 |
| 6,533,629 | B1 | 3/2003 | Boehler | |
| 6,597,089 | B2 | 7/2003 | Matsutani | |
| 7,740,513 | B2 | 6/2010 | Mueller | |
| 8,760,044 | B2 | 6/2014 | Ma | |
| 8,766,519 | B2 | 7/2014 | Ma | |
| 8,810,120 | B2 | 8/2014 | Sumoyama | |
| 9,231,380 | B2 | 1/2016 | Ma | |

(Continued)

FOREIGN PATENT DOCUMENTS

| | | | |
|---|---|---|---|
| DE | 2508490 | A1 | 9/1976 |
| DE | 4203249 | A1 | 8/1993 |

(Continued)

*Primary Examiner* — Ashok Patel
(74) *Attorney, Agent, or Firm* — Reising Ethington, P.C.

(57) ABSTRACT

A spark plug having at least one center or ground electrode that includes a first base metal or a first base metal alloy and a precious metal or a precious metal alloy. The at least one electrode has a surface bordering a spark gap that is made of a composite material in which crystalline particles of the precious metal or precious metal alloy are mixed with the first base metal or the first base metal alloy, and a portion of the particles of the precious metal or precious metal alloy forms a portion of the surface that borders the spark gap.

16 Claims, 3 Drawing Sheets

(56) References Cited

U.S. PATENT DOCUMENTS

| | | | | |
|---|---|---|---|---|
| 2006/0028106 | A1* | 2/2006 | Lineton | H01T 13/20 313/139 |
| 2013/0099654 | A1* | 4/2013 | Ma | H01T 21/02 313/141 |
| 2013/0285533 | A1* | 10/2013 | Ma | H01T 13/39 313/141 |
| 2013/0313961 | A1* | 11/2013 | Ma | H01T 13/39 313/141 |
| 2013/0344765 | A1* | 12/2013 | Ma | H01T 21/02 445/7 |
| 2014/0015399 | A1* | 1/2014 | Ma | H01T 13/39 313/141 |
| 2014/0103792 | A1 | 4/2014 | Ma | |
| 2014/0265812 | A1* | 9/2014 | Ma | H01T 21/02 313/141 |

FOREIGN PATENT DOCUMENTS

| | | | |
|---|---|---|---|
| DE | 102004019205 | A1 | 11/2005 |
| DE | 102005015413 | A1 | 10/2006 |
| DE | 60038297 | T2 | 4/2009 |
| EP | 1576707 | | 5/2010 |
| WO | 01/05009 | * | 1/2001 |
| WO | WO2014177169 | A1 | 11/2014 |

* cited by examiner 1
6
2
5
10
3
3
11
3
8
11
7
4
8
9

SPARK PLUG

This application claims the benefit of German Application No. 10 2015 121 862.3, filed on Dec. 15, 2015 the contents of which are hereby incorporated by reference in their entirety.

FIELD

The present invention is generally related to spark plugs and, more particularly, to spark plug components made from metal injection molding (MIM).

BACKGROUND

In a prior art spark plug, the center electrode and the ground electrode are each provided with an end piece, called a firing tip, that is made of a precious metal alloy primarily containing iridium. These end pieces are bonded to the center electrode and the ground electrode by laser welding. The purpose of tipping the electrodes with end pieces made of an iridium alloy is to extend the service life of the spark plug, which iridium and iridium alloys are well suited for. However, iridium is a costly precious metal.

SUMMARY

An object of the present design is to reduce the cost of manufacturing spark plugs.

This object may be attained by a spark plug with the features specified in claim 1. Advantageous further developments are the subject matter of the dependent claims.

In contrast to the prior art, the part of the electrode or electrodes of the present invention that represents a boundary of the spark gap is not made entirely of a precious metal or precious metal alloy. Instead, the precious metal or precious metal alloy is a constituent of a composite material in which crystalline particles composed of the precious metal or precious metal alloy are mixed with crystalline particles composed of the first base metal or the first base metal alloy. This can manifest in that the particles made of the precious metal or precious metal alloy are distributed in a partially or fully coherent material (matrix) made of the first base metal or the first base metal alloy, or in that the particles made of the first base metal or the first base metal alloy are distributed in a partially or fully coherent material (matrix) made of the precious metal or precious metal alloy. The composite material can be a mixture of the said constituents or a matrix composite material, which is to say a composite material in which the particles of the precious metal or precious metal alloy are predominantly embedded like islands in a matrix made of the first base metal or first base metal alloy, or in which the particles of the first base metal or first base metal alloy are predominantly embedded like islands in a matrix made of the precious metal or precious metal alloy. In addition, the composite material can be a hybrid of a mixture and a matrix composite material. In the composite material, particles composed of the precious metal or precious metal alloy can also form tracks consisting of a series of contiguous particles made of the precious metal or precious metal alloy in a matrix consisting of the first base metal or first base metal alloy. Alternatively, in the composite material, particles composed of the base metal or base metal alloy can form tracks consisting of a series of contiguous particles made of the first base metal or first base metal alloy in a matrix made of the precious metal or precious metal alloy.

At the surface of the composite material bordering the spark gap, individual particles of the precious metal or precious metal alloy appear in an environment composed of the first base metal or first base metal alloy. The use of the composite material for tipping electrodes in spark plugs is a significant difference from some prior art, in which the part of the surface of an electrode (center electrode and/or ground electrode) bordering the spark gap is composed entirely of a precious metal or precious metal alloy. According to the invention, at least one of the surfaces of the electrodes bordering a spark gap is only partly composed of the precious metal or precious metal alloy and the remainder is composed of the first base metal or first base metal alloy. The volume ratio of the precious metal or precious metal alloy to the first base metal or first base metal alloy in the composite material can be from 10:90 to 90:10; preferably it is from 30:70 to 60:40, for example approximately 50:50. When the ignition electrodes are tipped with such a composite material, the quantity of the costly precious metal required for this purpose can be reduced—as compared to the prior art—and thus the cost of manufacturing the spark plugs can be reduced. Alternatively, if the same quantity of a precious metal or precious metal alloy is used, the size of the surfaces bordering the spark gap over which the electrode consumption is distributed can be increased commensurately, and thus the service life of the spark plugs can be increased.

The composite material extends to a certain depth beneath the surface it forms on the ignition electrode tipped with the composite material in order to allow the spark plug to reach a desired degree of consumption in operation, at which point the spark plug is replaced. The thickness with which the composite material is provided on the ignition electrodes can be chosen in just the same manner as the thickness of the end pieces composed of a precious metal or precious metal alloy provided in the prior art, although this is by no means imperative.

When a spark plug according to the present design is first placed in service, the eroding effect of the ignition sparks on the surfaces that delimit the spark gap or spark gaps initially causes a loss (consumption) primarily of the first base metal or the first base metal alloy. The consequence of this is that the particles of the precious metal or precious metal alloy project to a greater degree from the applicable surface delimiting the spark gap. On the surface bordering the spark gap of the spark plug, the protruding particles of the precious metal or precious metal alloy can form "islands," between which the first base metal or the first base metal alloy forms the surface. Because of the point effect arising in the electric field in the spark gap at the projecting precious metal particles or precious metal alloy particles, in most cases the ignition sparks will start from a particle of the precious metal or precious metal alloy and strike an opposing particle of the precious metal or precious metal alloy on the opposite ignition electrode. In cases in which an ignition spark has a base point on a region of the first base metal or the first base metal alloy and/or strikes the opposite ignition electrode at a point that is composed of the first base metal or first base metal alloy, this can indeed cause greater erosion there than on the precious metal or precious metal alloy, but this ultimately has the result that the particles containing the precious metal or precious metal alloy only project all the further above the first base metal or first base metal alloy, thus enhancing the point effect of the electric field arising in the spark gap and increasing the probability that the ignition sparks will jump from one precious metal particle or from one precious metal alloy particle to an opposing precious metal particle or precious metal alloy particle.

This has potential advantages: firstly, the voltage (ignition voltage) necessary for generating the ignition sparks decreases, and secondly the erosion of the first base metal or first base metal alloy is slowed, which is good for the service life of the spark plug. A potentially reduced service life of the spark plugs resulting from the presence of the first base metal or first base metal alloy in the surfaces that border the spark gap can be more than compensated for according to the present design in terms of the cost of the spark plugs by the savings on costly precious metal.

Another potential advantage is that a molded part made of the composite material according to the present design can be welded to one end of the base-metal section of an ignition electrode—to the center electrode as well as to the ground electrode(s)—entirely without problems because the two surfaces to be welded to one another can be made predominantly of the same first base metal or predominantly of the same first base metal alloy. Problems that have occurred in the prior art due to the welding of an end piece made of a precious metal or of a precious metal alloy to the base-metal section of the ignition electrode because of different coefficients of thermal expansion and other metallurgical incompatibilities are less significant when the method according to the invention is used. Molded parts made of the composite material according to the invention can be welded directly to the base-metal section of the center electrode or ground electrode(s) using proven standard welding methods, for example through Joule heat alone. This substantially reduces the manufacturing costs for the spark plugs.

Preferably, all surfaces that border one or, if applicable, more spark gaps in the spark plug are made of the composite material according to the present design.

The first base metal or the first base metal alloy can have a composition that is normally used for spark plugs. The use of nickel and nickel-based alloys is known and suitable, in particular nickel-based alloys such as, e.g., alloys that contain at least 72 percent by weight of nickel, 14-17 percent by weight of chromium, and 6-10 percent by weight of iron, which have proven very successful in practice; one such Ni—Cr—Fe alloy is available under the brand name Inconel 600. Other high-temperature alloys can be used as well if they are sufficiently corrosion-resistant in the operating conditions in an internal combustion engine.

The precious metals or precious metal alloys used for tipping the ignition electrodes can likewise be the same ones that are already known for use in spark plugs, in particular iridium and platinum as well as alloys of iridium and platinum, in particular an alloy composed of iridium and platinum or an alloy composed of iridium and rhodium. The iridium alloy may consist predominantly of iridium; for example, less than 95 percent by weight of iridium. The precious metal alloy may also contain minor quantities of one or more base metals, in particular the ones from subgroups 3B and 4B of the periodic table of elements, for example zirconium, titanium, hafnium, and yttrium.

Preferably, molded parts made of the composite material according to the present design are produced by powder metallurgy, for example, using a metal injection molding (MIM) process. This method is especially suitable for producing small bodies such as are required for tipping ignition electrodes. Metal injection molding as such is prior art, but not for the present application case. For the present application case, a powder of a nickel alloy—preferably, the same alloy that was used in the base-metal section of the center electrode and the ground electrode(s)—and a powder of a precious metal alloy with the addition of a plastic-based binder, for example, can be mixed together and a coherent mass—the feedstock—can be formed by compounding, which is then used to produce, by injection molding, molded articles that are referred to as "green parts." Next, the green part is debound, which means the binder is removed from the green part. Depending on the binders used, the debinding can be accomplished using water or other solvents or by heating, wherein the binder can be decomposed and expelled from the green part. It is also possible to use several of these methods for debinding. The debound molded article is referred to as a brown part. The brown part is sintered and is solidified by this means. Alternatively, a strand could be formed from the feedstock through extrusion, debound, divided into smaller sections, and these sections then sintered. Depending on the choice of binder and the porosity of the green part, the debinding can take place before or after cross-cutting of the strand and potentially even after the sintering. The cross-cutting of the strand can also potentially take place after the sintering.

Another possibility for making the green part of a molded part out of a composite material according to the invention consists in using a 2D printer or 3D printer to print the mixture of the metal powders and a binder on a substrate that the composite material does not bond to, debinding the printed green part, and sintering the brown part thus formed.

The form of the molded part can be matched to the electrode form specified in the individual case and can be, for example, a circular plate, a ring, a rectangular parallelepiped, or a rivet. Other geometric shapes of the molded part are possible as well. Metal injection molding (MIM) also permits complex shaping. The present design is suitable for tipping all electrode forms that occur in spark plugs in practice.

In the composite material produced by powder metallurgy, the average size of the particles composed of the precious metal or precious metal alloy can be smaller than, equal to, or larger than the average size of the particles composed of the first base metal or first base metal alloy. Preferably, the average size of the particles composed of the precious metal or precious metal alloy is smaller than the average size or equal to the average size of the particles composed of the first base metal or first base metal alloy. In order to ensure comparability of the size specifications, the average particle size should always be determined by the same method, for example by the intercept method.

Preferably, the particles composed of the precious metal or precious metal alloy have a maximum size of 50 μm and a minimum size of 5 μm. Particle size is understood here to mean, in particular, an equivalent diameter of the particles. Specifically, the term "particle size" is understood to mean a geometric equivalent diameter, in particular a volume equivalent sphere diameter or a surface equivalent sphere diameter. A geometric equivalent diameter is obtained by determining the diameter of a sphere having the same geometric characteristic (surface or volume) as the irregularly shaped particle. A volume equivalent sphere diameter is the diameter of a sphere having the same volume as the considered particle. A surface equivalent sphere diameter is the diameter of a sphere having the same surface size as the considered particle. Moreover, the term "particle size" is understood to mean, in particular, an average value of an equivalent diameter distribution. The size of the particles composed of the precious metal or precious metal alloy may be in the range from 10 μm to 30 μm, even better in the range from 15 μm to 25 μm. This is favorable for achieving a long service life of the spark plug. The more the particles composed of the precious metal or precious metal alloy are in this size range, the better the spark plug behaves.

In the composite material, the volume fraction of particles composed of the precious metal or precious metal alloy can be larger than, equal to, or smaller than the volume fraction of the first base metal or first base metal alloy. The fraction of the precious metal or precious metal alloy can be between 10 percent by volume and 90 percent by volume, preferably between 20 percent by volume and 80 percent by volume or between 30 percent by volume and 70 percent by volume, in particular between 40 percent by volume and 60 percent by volume, for example, approximately 50 percent by volume. In this way, it is possible to realize a substantial precious metal saving and cost saving as compared to the prior art. Another potential advantage resides in the fact that, in comparison to the prior art where a molded part made of iridium or an iridium alloy is welded onto an ignition electrode made of a nickel-based alloy such as, e.g., Inconel 600, the difference between the coefficients of thermal expansion of the molded part made of the composite material and the nickel-based alloy that the center electrode or ground electrode is composed of, if applicable together with a core made of copper or a copper alloy, apart from the composite material according to the present design, is smaller. This has the advantage, firstly, that the load resulting from thermal stress on the weld zone between the molded part and the nickel-based alloy is smaller than in the prior art, and this has the further advantage that the molded part made of the composite material can be welded to the main part of the center electrode or ground electrode made of the nickel-based alloy with far less effort, most easily by means of electric resistance welding. Cost-intensive intermediate layers for mutual adaptation of the coefficients of thermal expansion and additional costly laser welding or electron beam welding, which have hitherto been used in the prior art, can be dispensed with.

Another potential advantage results from the fact that the difference between the coefficient of thermal expansion of the precious metal or precious metal alloy and the larger coefficient of thermal expansion of the first base metal or first base metal alloy, which difference is effective within the composite material, in particular the difference between the coefficient of thermal expansion of iridium or an iridium alloy and the larger coefficient of thermal expansion of a nickel-based alloy such as, e.g., Inconel 600, has the result that, as the temperature rises, pressure is exerted on the particles composed of the precious metal or precious metal alloy by the first base metal or first base metal alloy contained in the composite material and surrounding the particles composed of the precious metal or precious metal alloy, so that these particles are fixed especially firmly in the composite material, which ensures a robust mechanical bond and is good for low electrode consumption and a long service life of the spark plug.

The base-metal main section of the center electrode and/or ground electrode(s) preferably is made of the same first base metal or the same first base metal alloy that is also a constituent of the composite material with which the electrodes are tipped. The base-metal section of the electrodes can also have, in addition, a core made of a different base metal or a different base metal alloy whose coefficient of thermal expansion is greater than that of the first base metal or the first base metal alloy, in particular copper. However, the core should not extend to the weld zone between the composite material and the base-metal main section of the electrodes that are tipped with the composite material.

DRAWINGS

Preferred exemplary embodiments will hereinafter be described in conjunction with the appended drawings, wherein like designations denote like elements, and wherein.

DESCRIPTION

Figure 1:
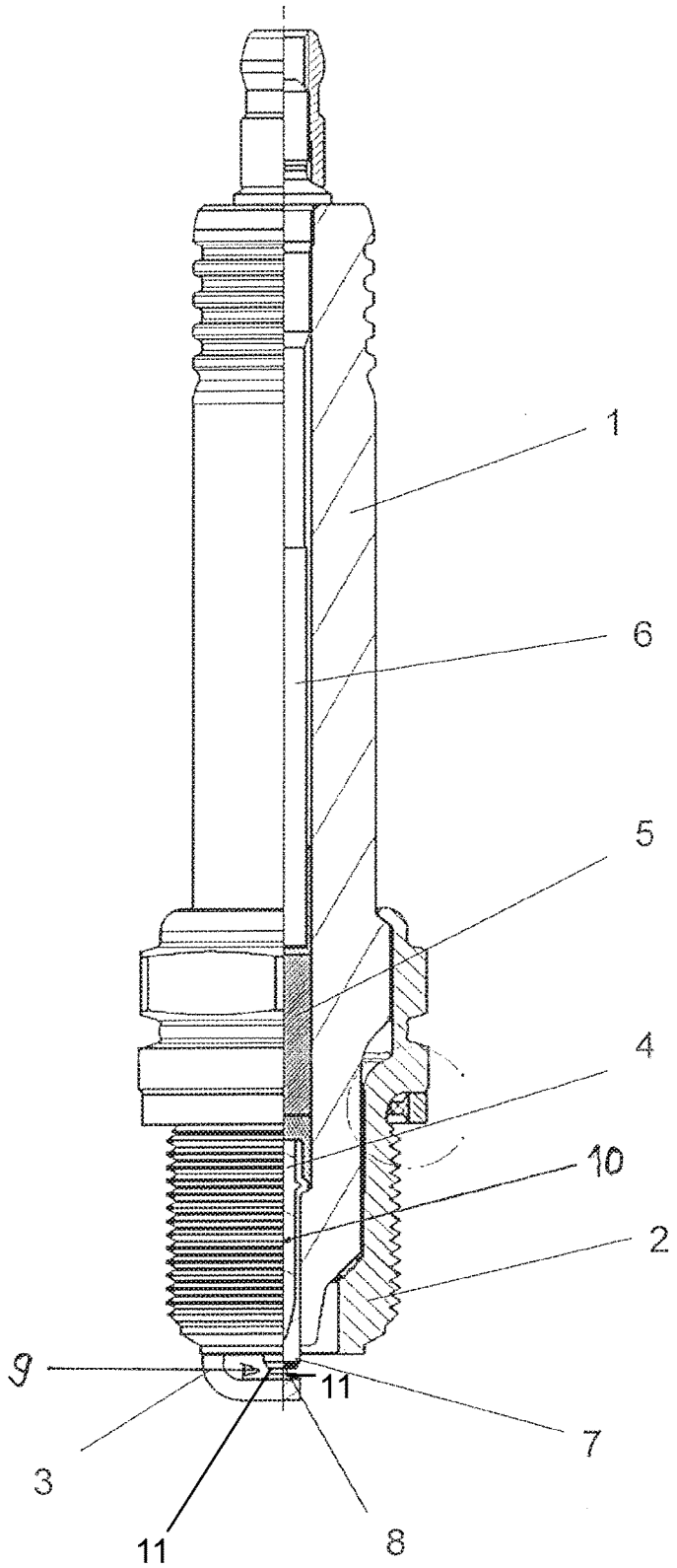
FIG. 1 shows a typical spark plug, partially in a side view, partially in a longitudinal section.

FIG. 1 shows a spark plug with a metallic shell 2 made, e.g., of a steel. The spark plug has a center electrode 4 and a ground electrode 3, which are composed predominantly of a first base metal alloy, for example nickel-based, and a core 10 made of copper. The ground electrode 3 originates from the front edge of the shell 2 and is bent over toward the center electrode 4. The center electrode 4 is inserted in a ceramic insulator 1 and is connected by a fused glass element 5 to an electrical terminal element 6, which projects out of the back end of the insulator 1.

Welded onto the front end of the center electrode 4 and the ground electrode 3 in each case is a molded part 7 or 8 made of a composite material according to the present design that is composed of a mixture of particles of a precious metal or a precious metal alloy and particles of the first base metal or the first base metal alloy. The core 10 made of copper does not extend into the weld zone created by welding the molded part 7 onto the center electrode 4. The spark gap 9 of the spark plug is located between surfaces 11 of the two molded parts 7, 8.

Figure 2:
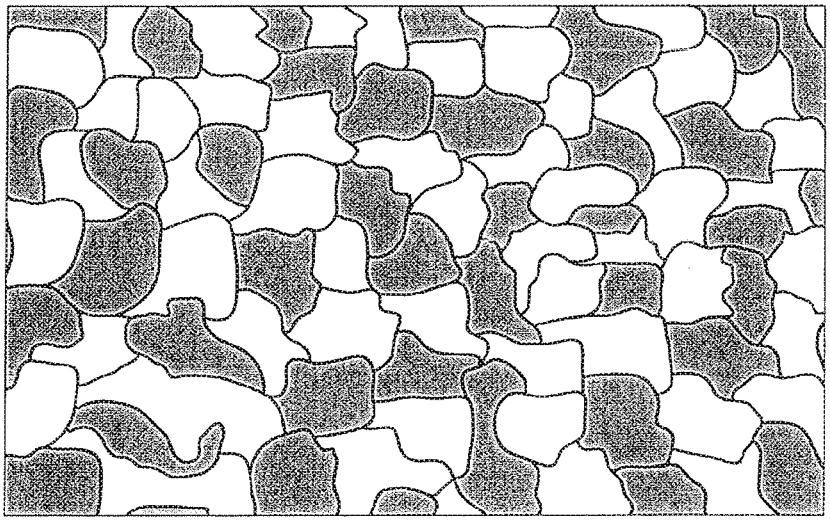
FIG. 2 shows, greatly simplified, one possible structure of a composite material used according to the present design in the spark plug.

FIG. 2 shows, greatly enlarged and simplified, one possible structure of the composite material with which the center electrode 4 and the ground electrode 3 of the spark plug shown as an example in FIG. 1 can be tipped. Particles of a first base metal alloy, for example Inconel 600, are shown in white. Particles of a precious metal or precious metal alloy, for example an iridium-platinum alloy, are shown as dark. The different particles form a mixture, and are present in a reasonably uniform distribution in the composite material.

Figure 3:
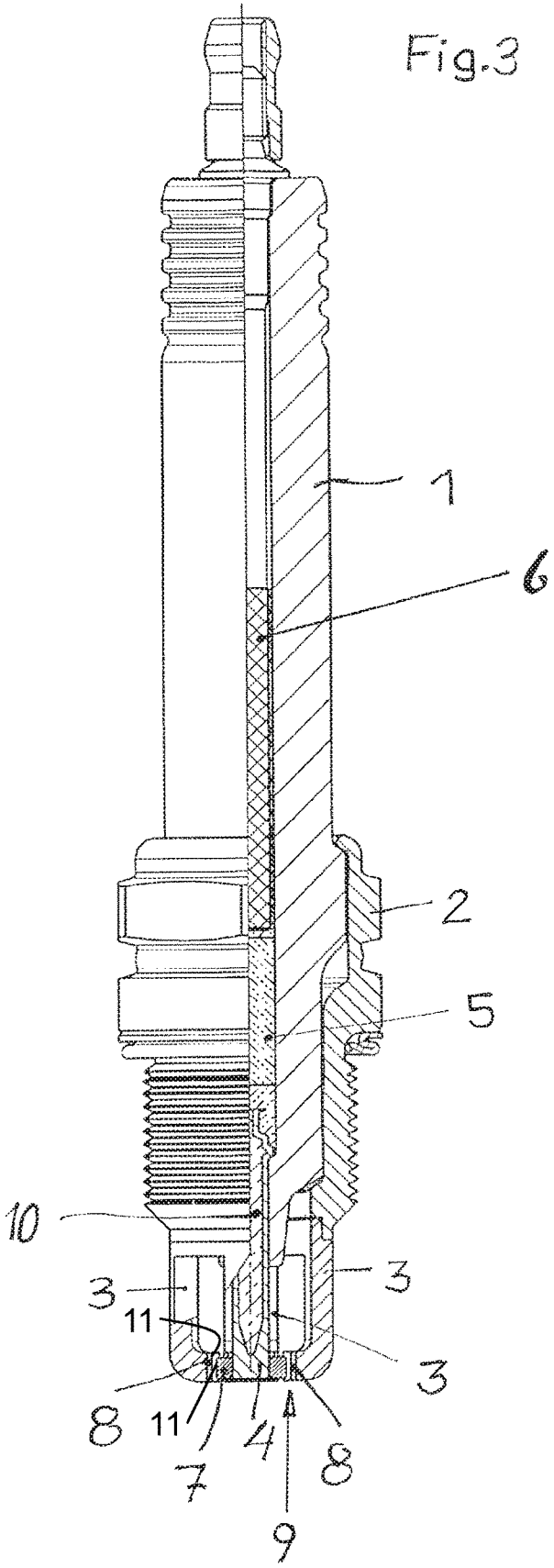
FIG. 3 shows another example of a spark plug, partially in a side view and partially in section

In FIG. 3, parts of the spark plug that correspond to the parts shown in FIG. 1 are labeled with corresponding reference numbers.

The spark plug shown in FIG. 3 differs from the spark plug shown in FIG. 1 primarily in that the center electrode 4 is surrounded by four ground electrodes 3 that are tipped with molded parts 8 made of a composite material according to the present design and that face the lateral surface of the center electrode 4, onto which is welded an annular molded part 7 made of a composite material according to the present design. The spark plug has four spark gaps 9 that are formed between the annular molded part 7 and the four molded parts 8 welded onto the ground electrodes 3.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

LIST OF REFERENCE NUMBERS

1 insulator
2 shell
3 ground electrode
4 center electrode
5 fused glass element
6 electrical terminal element
7 molded part
8 molded part
9 spark gap
10 copper core of the center electrode

The invention claimed is:

1. A spark plug having: a center electrode and one or more ground electrodes that are separated from the center electrode by an insulator; between the center electrode and the one or more ground electrodes is one or more spark gaps; at least one of the center or ground electrodes is composed of a first base metal or a first base metal alloy, and the at least one of the center or ground electrodes is at least partially composed of a precious metal or precious metal alloy; wherein at least one of the center or ground electrodes has a surface bordering the one or more spark gaps that is made of a composite material in which particles of the precious metal or precious metal alloy are mixed with the first base metal or the first base metal alloy, and a portion of the particles of the precious metal or precious metal alloy forms a portion of the surface bordering the one or more spark gaps, wherein a plurality of particles of the precious metal or the precious metal alloy are wholly surrounded by particles of the first base metal or the first base metal alloy.

2. The spark plug according to claim 1, wherein the particles of the precious metal or precious metal alloy are distributed in a matrix made of the first base metal or the first base metal alloy.

3. The spark plug according to claim 1, wherein all surfaces that border the one or more spark gaps are made of the composite material.

4. The spark plug according to claim 1, wherein the first base metal is nickel or the first base metal alloy is a nickel-based alloy.

5. The spark plug according to claim 4, wherein the nickel-based alloy is a high-temperature alloy predominantly containing nickel, chromium, and iron.

6. The spark plug according to claim 1, wherein the precious metal is iridium or platinum or the precious metal alloy is an iridium alloy or a platinum alloy or an iridium-platinum alloy or an iridium-rhodium alloy.

7. The spark plug according to claim 1, wherein the composite material is produced by means of a powder metallurgy process from a precious metal powder or a precious metal alloy powder as well as from a powder of the first base metal or the first base metal alloy.

8. The spark plug according to claim 7, wherein a molded part is formed and sintered from the composite material by means of a metal injection molding process.

9. The spark plug according to claim 1, wherein the composite material has a volume ratio of the precious metal or precious metal alloy to the first base metal or first base metal alloy that is from 10:90 to 90:10.

10. The spark plug according to claim 7, wherein the composite material has an average size of the particles composed of the precious metal or precious metal alloy that is smaller than an average size or equal to an average size of the particles composed of the first base metal or first base metal alloy.

11. The spark plug according to claim 7, wherein the particles composed of the precious metal or precious metal alloy in the composite material have a size from 10 μm to 30 μm.

12. The spark plug according claim 1, wherein the first base metal or first base metal alloy has a lower melting point than the precious metal or precious metal alloy.

13. The spark plug according to claim 8, wherein a main section in at least one of the center or ground electrodes is integrally joined to the molded part that is made of the composite material through electric resistance welding.

14. The spark plug according to claim 8, wherein the molded part is a circular plate, a ring, a rectangular parallelepiped, or a rivet.

15. The spark plug according to claim 1, wherein a portion of the center electrode or of the ground electrode(s) that is not made of the composite material is composed of the first base metal or first base metal alloy and a core that does not extend to the composite material and whose coefficient of thermal expansion is greater than that of the first base metal or the first base metal alloy.

16. A spark plug comprising: a center electrode and one or more ground electrodes that are separated from the center electrode by an insulator; between the center electrode and the one or more ground electrodes is one or more spark gaps; at least one of the center or ground electrodes is composed of a first base metal or a first base metal alloy, and the at least one of the center or ground electrodes is at least partially composed of a precious metal or a precious metal alloy; wherein at least one of the center or ground electrodes has a surface bordering the one or more spark gaps that is made of a composite material in which particles of the precious metal or precious metal alloy are mixed with the first base metal or the first base metal alloy, and a portion of the particles of the precious metal or precious metal alloy forms a portion of the surface bordering the one or more spark gaps, wherein the composite material is produced by a powder metallurgy process from mixing a precious metal powder or a precious metal alloy powder with a powder of the first base metal or the first base metal alloy, wherein a molded part is formed and sintered from the composite material by means of a metal injection molding process, the molded part being welded to the at least one of the center or ground electrodes to form the surface bordering the one or more spark gaps.

* * * * *